US005557915A

United States Patent [19]

Knoff et al.

[11] Patent Number: 5,557,915

[45] Date of Patent: Sep. 24, 1996

[54] METHOD AND APPARATUS FOR MAKING ALTERNATE TWIST PLIED YARN AND PRODUCT

[75] Inventors: Warren F. Knoff, Richmond, Va.; Robert W. McAllister; Peter Popper, both of Wilmington, Del.; Steven K. Shibata, Salisbury, Md.; Robert E. Taylor, Columbia; Paul W. Yngve, Chapin, both of S.C.

[73] Assignee: E. I. Du Pont de Nemours and Company, Wilmington, Del.

[21] Appl. No.: 339,103

[22] Filed: Nov. 14, 1994

[51] Int. Cl.[6] ..... D01H 3/26; D02G 3/02

[52] U.S. Cl. ..... 57/204; 57/236; 57/237; 57/242; 57/297

[58] Field of Search ..... 57/204, 200, 293, 57/205, 236, 237, 242, 297

[56] References Cited

U.S. PATENT DOCUMENTS

| | | | |
|---|---|---|---|
| 3,443,370 | 5/1969 | Walls | 57/204 |
| 3,468,120 | 9/1969 | Hildebrand | 57/204 |
| 3,488,939 | 1/1970 | Walls | 57/139 |
| 3,537,251 | 11/1970 | Kimura et al. | 57/204 |
| 3,744,232 | 7/1973 | Shah | 57/140 |
| 3,775,955 | 12/1973 | Shah | 57/34 |
| 4,173,861 | 11/1979 | Norris et al. | 57/293 |
| 4,186,549 | 2/1980 | Chambley et al. | 57/293 |
| 4,206,589 | 6/1980 | Markey et al. | 57/293 |
| 4,246,750 | 1/1981 | Norris et al. | 57/204 |
| 4,870,813 | 10/1989 | Nelson | 57/236 |
| 4,873,821 | 10/1989 | Hallam et al. | 57/293 |
| 5,012,636 | 5/1991 | Hallam et al. | 57/204 |
| 5,179,827 | 1/1993 | Tinsley et al. | 57/204 |
| 5,228,282 | 7/1993 | Tinsley et al. | 57/333 |

FOREIGN PATENT DOCUMENTS

| | | | |
|---|---|---|---|
| 2022154 | 12/1979 | United Kingdom | D02G 3/00 |
| 2023674 | 1/1980 | United Kingdom | D02G 3/00 |

*Primary Examiner*—William Stryjewski

[57] ABSTRACT

An alternate twist plied yarn formed from a plurality of strands of singles yarn twisted in alternating directions in lengthwise intervals of first half-cycles of twist at a predetermined twist level followed by second half-cycles of twist at the same twist level with reversal nodes therebetween, the singles twisted yarns being ply-twisted together in alternating directions in lengthwise intervals of first half-cycles of ply-twist followed by second half-cycles of ply-twist, there being a bond formed adjacent each node wherein the first half-cycle of ply-twist is located within the bond and the second half-cycle of ply-twist originates at one end of the bond, the twist level in the singles twisted yarn is between 25% in the same direction and 60% in the opposite direction of the twist applied to the singles yarns before plying. The process for making an alternate twist plied yarn formed from a plurality of singles strands wherein the plied yarn has low residual singles twist is disclosed as well as an apparatus for forming bonded alternate twist plied yarn from a plurality of strands having a distance between twist reversal nodes defining sections of alternate twist in the yarn and having bonds in the plied yarn adjacent the reversals.

9 Claims, 7 Drawing Sheets

METHOD AND APPARATUS FOR MAKING ALTERNATE TWIST PLIED YARN AND PRODUCT

DESCRIPTION

1. Technical Field

This invention relates to an alternate twist plied yarn having a bond made in the plied strands before the manner of twisting the strands is changed and the manner of producing such yarns.

2. Background

Such plied yarns are made by advancing and twisting individual yarn strands, bringing them together and allowing them to spontaneously ply about one another as they move axially through the system at speeds often exceeding 200 YPM. The plied yarn is periodically stopped and bonded before the twisting and plying is reversed as described in U.S. Pat. No. 4,873,821, which is incorporated herein by reference.

For a given yarn and yarn denier, the torque or twist force exerted by each strand is roughly proportional to the amount of twist therein and such force decreases as the strands ply. The spontaneous plying continues until the stored twist forces in each strand decreases to a point at which the remaining twist forces are exactly counterbalanced by the resistance to further twisting in the plied yarn.

Due to frictional forces resisting the plying forces, not all of the twist applied to the single strands is converted to ply twist in the stable plied yarn; it has been found for two 1050 denier plied strands of nylon bulked multifilaments that typically only about 60% to 70% of the twist in the singles yarn is converted to ply twist during spontaneous plying with no external assist or restraint to the plying. That is, the number of turns per inch of stable ply twist (PT) is equal to 0.6 times the number of turns per inch of applied singles twist (AS) or PT=0.6 AS. The amount (turns per inch) of singles twist applied to the yarn is always greater than the amount of ply twist achieved; for instance, 6 turns per inch of applied singles twist will produce about 4 turns per inch of stable ply twist, and 2 turns per inch of residual twist (SR) will remain in the singles yarn.

For some products, the residual singles twist may be advantageous since it results in a more tightly gathered bundle of singles filaments that may be desired for special color or dense yarn effects, or better wear performance for some applications. When the plied yarn is used in cut pile carpets, however, it is often desirable to have low or no residual singles twist to thereby increase the fullness of the plied tufts, decrease the tendency for individual strands to split at the tuft tips into separate single strands, and decrease the tendency for small ply twist variations to cause large light reflectance variations or streaks in the finished carpet.

British published patent application 2,022,154 describes a process for making an alternate ply twist product by converting essentially all of the singles twist to ply twist. In the examples given, torque is applied to the plied yarn in the direction of ply and the overplied yarn is passed through a "light steam flame" for less than a second. When the added torque is released, the yarn reaches a stable state where the number of turns of ply twist is about equal to the number of turns of applied singles twist. A process for continuously converting singles to ply twist is disclosed where steam or hot air is applied through a jet to heat and apply torque to the continuously advancing plied yarn, with the twist direction reversed as the ply twist node passes a twist trap adjacent the jet. The application is silent on how the timing of the twist reversal of the jet is continuously coordinated with the node reaching the twist trap. The alternate twist plied yarn product has the strands fixed together between ply reversals by joining the singles strands at the singles twist reversal nodes while the strands are side-by-side before plying. Such joining is thought to be not highly reliable and it produces a relatively long ply reversal node that may be several plied yarn diameters long. Such a long reversal node may result in a section of yarn with no ply twist which is considered objectionable in cut pile carpets.

There is a problem that it is difficult to apply package winding tension to any alternate ply twisted yarn and especially twist converted, alternate ply twisted yarn, without causing the ply reversal node to rotate and transform the ply twist to singles twist. This problem is more pronounced with smaller denier yarn than with heavier denier yarns since it is believed the smaller diameter twisted bundle develops less ply torque than the larger diameter bundle. The problem is addressed in U.S. Pat. No. 4,186,549 and is solved therein by only applying a small tension and applying it over very short lengths of the yarn just before winding the yarn on a package. This is an improvement for winding, however, it still results in some ply loss which is now concentrated adjacent the reversal nodes. It is also troublesome to implement such a solution with some processes requiring long spans of yarn, such as the detangling bars of a Superba heat setting machine, and with some end uses of the yarn, such as in a tufting machine, where it is not always practical to keep yarn tension low and the tensioner close to the tufting needle.

U.S. Pat. No. 5,228,282 shows a process for making alternate twist ply yarn where a torque jet applies twist to each one of two or more single yarns; the yarns are allowed to spontaneously ply together to form a single plied strand assisted by a booster torque jet acting on the plied strand. The yarns and strand are periodically stopped for bonding of the single plied strand before the manner of twisting the yarns and strand is changed. The plied strand is accelerated and decelerated by a pair of puller rolls. The jet apparatus used for the torque and booster jets is comprised of a body and a cylindrical insert; the insert having a plurality of longitudinal yarn passages therethrough and means to apply twisting air to the passages to thereby twist the yarn or strand first in one direction and then in another.

Such a system is an improvement of the system of the '821 patent cited above and it works well, but it requires a separate pair of jets and a bonder for each plied yarn strand being made. This requires a significant amount of equipment and floor space when it is desired to make multiple strands of plied yarn. Such a system becomes expensive, especially if the yarn is a small denier carpet yarn, such as that often used in bathroom carpets. Low pounds per hour are produced from each twisting position.

There is a need for a system that reduces the equipment and floor space required and, therefore, the cost associated with each plied strand.

SUMMARY OF THE INVENTION

The invention is an alternate twist plied yarn formed from a plurality of strands of singles yarns twisted in alternating directions in lengthwise intervals of first half-cycles of twist at a predetermined twist level followed by second half-cycles of twist at the same twist level with reversal nodes therebetween, the singles twisted yarns being ply-twisted together in alternating directions in lengthwise intervals of first half-cycles of ply-twist followed by second half-cycles of ply-twist, there being a bond formed adjacent each node wherein the first half-cycle of ply-twist terminates within the bond and the second half-cycle of ply-twist originates at one end of the bond, the twist level in the singles twisted yarns is between 25% in the same direction and 60% in the opposite direction of the twist applied to the singles yarns before plying.

The invention also includes an alternate twist plied yarn product comprised of a plurality of alternate twist plied yarns with a bond at the ply twist reversal in each of the yarns, said plied yarns of the plurality of yarns are further alternate twist plied together to form a second or doubled alternate twist plied yarn with unbonded ply reversals and with the individual plied yarns in contact with one another to resist bond rotation in the individual plied yarns. Preferably, the bonded reversals of each of the plurality of yarns are in longitudinal alignment with each other and are in longitudinal alignment with the unbonded ply reversal of the second or doubled plied end. Preferably, the individual plied yarns have an average residual singles twist level of between 25% in the same direction and 60% in the opposite direction of the twist applied to the singles yarns before plying to form the individual plied yarns.

The process for making an alternate twist plied yarn formed from a plurality of single strands wherein the plied yarn has low residual singles twist, includes the steps of:

advancing the strands at a predetermined rate under tension in a path adjacent each other;

twisting the strands each the same in a first direction and rate as they advance along said path;

plying the twisted strands to form a first half-cycle of plied yarn;

advancing said plied yarn at a first predetermined rate at a first tension using a first roll advancing means;

advancing said plied yarn at a second predetermined rate less than said first rate and at a second tension less than said first tension using a second roll advancing means spaced from said first roll advancing means by a distance that is predetermined to place a previously formed bond adjacent the second roll advancing means when the advancing of the yarns is stopped;

twisting the plied yarn at a position adjacent the upstream side of the second roll advancing means to overply the plied yarn;

stopping the advancing of said strands and said plied yarn;

bonding said plied yarn to form a bond;

stopping the twisting of the strands, and stopping the twisting of the plied yarn, then;

repeating said steps while twisting said strands each the same in the opposite manner, and twisting said plied yarns each the same in the opposite manner, to form a second half-cycle of plied yarn substantially the same as the first half-cycle of plied yarn.

Preferably, the process handles a plurality of yarns and produces a multiple of plied yarns side-by-side, each plied yarn experiencing the same twisting, bonding, advancing, overplying and stopping; and the multiple yarns are brought together after overplying and allowed to ply together to form a second, or doubled, plied end so the individual plied yarns contact each other along their length to thereby resist rotation of the bonded reversals in the individual plied yarns.

Preferably, the process includes heating the plied strands so the yarn is hot when it is overplied. Preferably, the process includes preheating the plied yarns before overplying and heating the plied yarns in the overply jet.

The invention is also an improved method of forming a plurality of ply twisted yarns simultaneously, with or without the above mentioned subsequent twist conversion, comprising:

advancing a plurality of strands through closely spaced passages in a torque jet and twisting the strands each the same in a first direction and rate as they advance along said path;

plying together two or more of the twisted strands to form a plurality of individual plied yarns that are closely spaced side-by-side;

advancing the individual plied yarns through a booster torque jet and twisting the plied yarns in the plying direction, each plied yarn passing through a separate passage with the passages closely spaced side-by-side;

stopping the advancing of said strands and plied yarns;

aligning a single ultrasonically energized horn surface so that it extends beyond the closely spaced side-by-side plied yarns;

squeezing each of the plied yarns simultaneously between the single ultrasonically energized horn surface and a single complementary ultrasonic anvil surface to thereby bond the twisted strands together in each plied yarn, while keeping the plied yarns separate.

The apparatus for forming bonded alternate twist plied yarn from a plurality of strands having a distance between twist reversal nodes defining sections of alternate twist in the yarn and having bonds in the plied yarn adjacent the reversals includes:

a source of supply of the strands;

a means for tensioning the strands;

a means for twisting the strands in alternating directions and combining them to form plied yarn;

a means for bonding said plied yarn before reversing said twisting;

first means for advancing and stopping said yarn;

second means for advancing and stopping said yarn;

means for coordinating the second means for advancing and stopping with said first means for advancing and stopping said yarn;

means for overplying said plied yarn adjacent the upstream side of said second means for advancing; and means for coordinating the means for overplying said plied yarn with the second means for advancing and stopping said yarn.

Preferably, the apparatus includes a means for heating said plied yarn adjacent the upstream side of said second means for advancing and stopping.

DETAILED DESCRIPTION OF THE DRAWINGS

Figure 1:
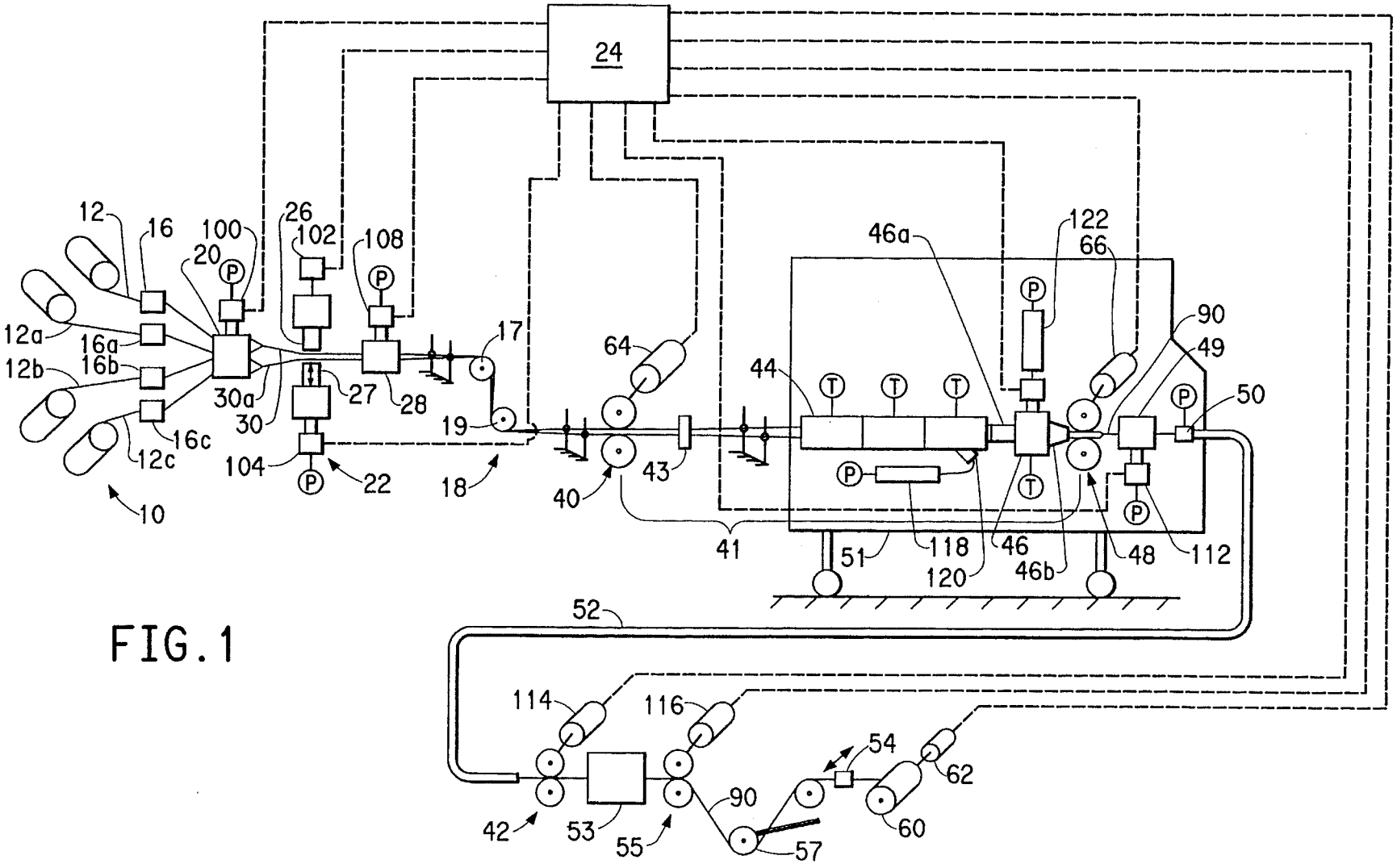
FIG. 1 is a schematic drawing of the apparatus and associated control system used to practice the invention.

FIG. 1 is an overall diagram of the system of the invention for processing two individual plied yarn strands simultaneously in a side-by-side relation and eventually bringing the alternate twist plied strands together and allowing them to alternate twist ply to form a second alternate twist plied "doubled" yarn with no bond at the ply reversals. Each of the individual plied yarns is formed by combining two single yarn strands into an alternate twist plied yarn having good ply twist uniformity and low residual singles twist, wherein low residual singles twist is between 25% in the same direction and 60% in the opposite direction of the applied singles twist. The bond in the yarns fix the single strands to each other to prevent untwisting and unplying. They must have sufficient strength to resist separating under tension and abrasion encountered in subsequent heat treating and winding of the yarn, and tufting of the yarn into carpet. While the preferred embodiment of the invention utilizes ultrasonic energy to fuse the yarns to form a bond, one skilled in the art may apply other sources of energy such as radiant energy from lasers or other sources. Also, other means of bonding such as adhesives or filament entanglement, or a combination of the above bonding means may be employed. Preferably, the bond is that described in the referenced '821 patent where the bond is formed adjacent a reversal node wherein a first half-cycle of ply twist terminates within (is located within) the bond and a second half-cycle of ply twist originates at one end of the bond.

Single yarn strands 12, 12*a* and 12*b*, 12*c* are supplied from sources 10, such as wound packages, and are fed through tensioners 16, 16*a* and 16*b*, 16*c* for tensioning each strand; the tensioners also act as "twist stops". All singles strands are advanced simultaneously, each through a separate passage in torque jet 20 that applies torque separately to each strand and causes twisting of each strand. The strands 12 and 12*a* are positioned in close proximity to one another at the exit of jet 20 while advancing and are allowed to ply together to form plied yarn 30. The strands 12*b* and 12*c* are also positioned in close proximity to one another (less than ½" apart) at the exit of jet 20 while advancing and are allowed to ply together to form plied yarn 30*a*. The plied yarns 30 and 30*a* are advanced simultaneously, each through a separate passage in booster torque jet 28 that applies torque separately to each plied yarn 30 and 30*a* to assist plying in the space between jets 20 and 28. Yarn bonder 22, positioned between the jets, periodically bonds the plied yarn 30 and 30*a* by simultaneously squeezing the plied yarns, when they are stopped side-by-side, between an ultrasonically energized horn 26 and a moveable anvil 27. Torque jet 20, that positions strands 12, 12*a* and 12*b*, 12*c*, and booster torque jet 28 that positions plied yarns 30 and 30*a*, are placed in close proximity to one another (less than 3.0" of space between them). This close proximity keeps the yarns from vibrating under the action of the jets that may cause plied strands 30 and 30*a* to tangle together or to move out from between the horn and anvil. The bonder 22 fits between closely spaced jets 20 and 28.

Figure 2:
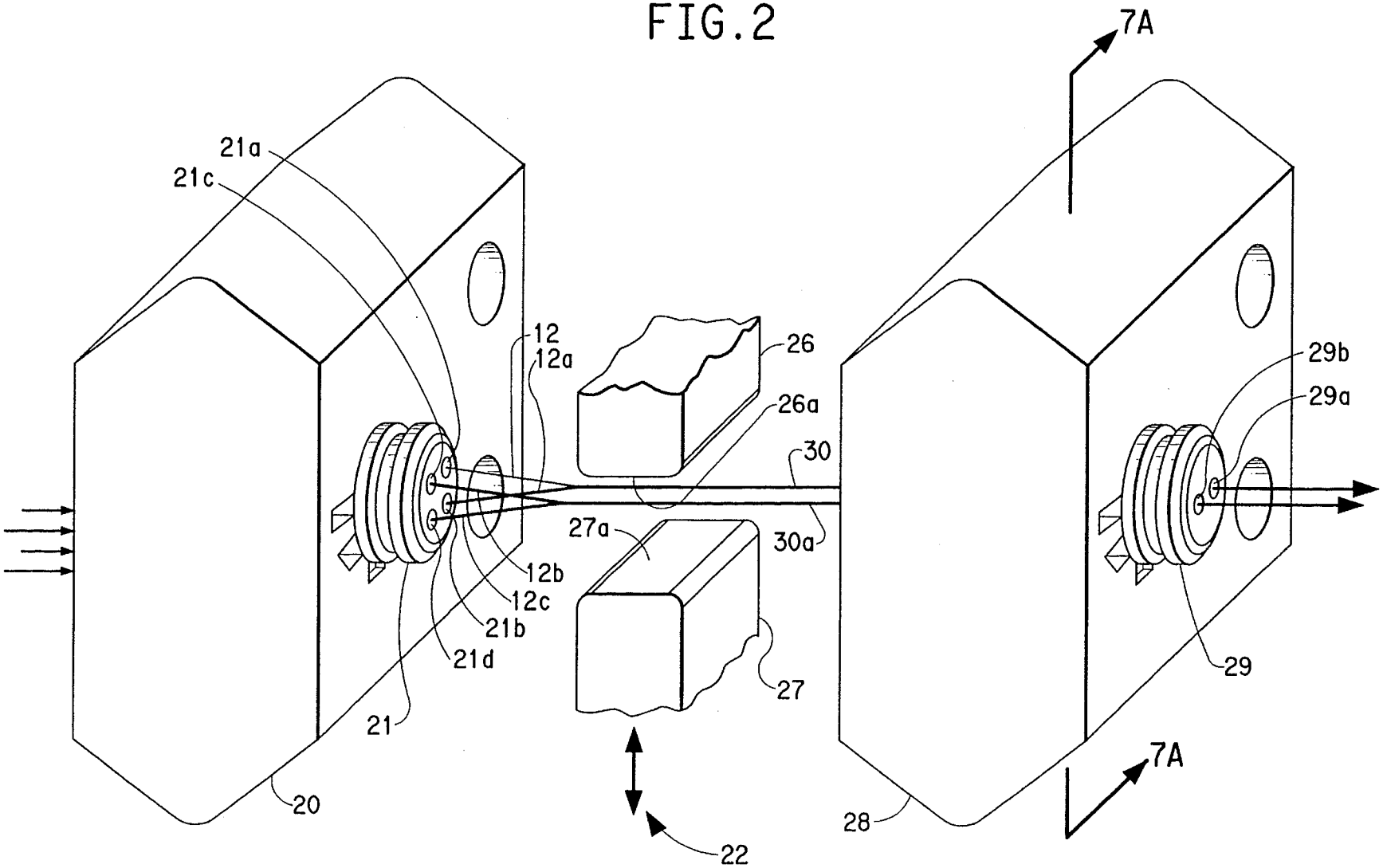
FIG. 2 is an enlarged isometric view of the closely spaced jets and bonder of FIG. 1.
Figure 3A:
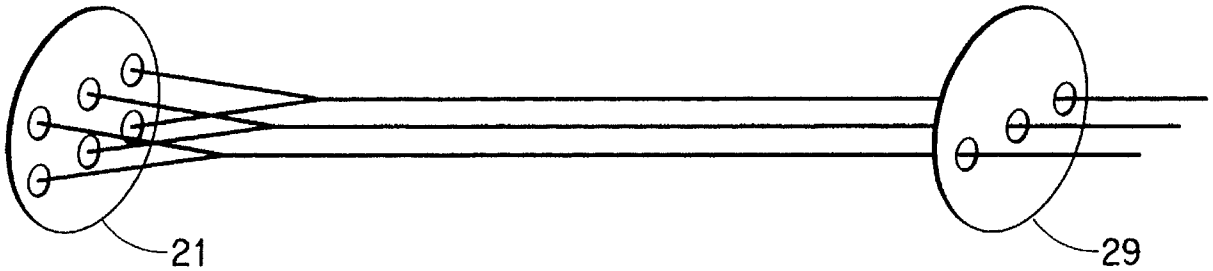
FIGS. 3A–3C are diagrammatic views of different geometries for the closely spaced passages in the jets of FIG. 2.
Figure 3B:
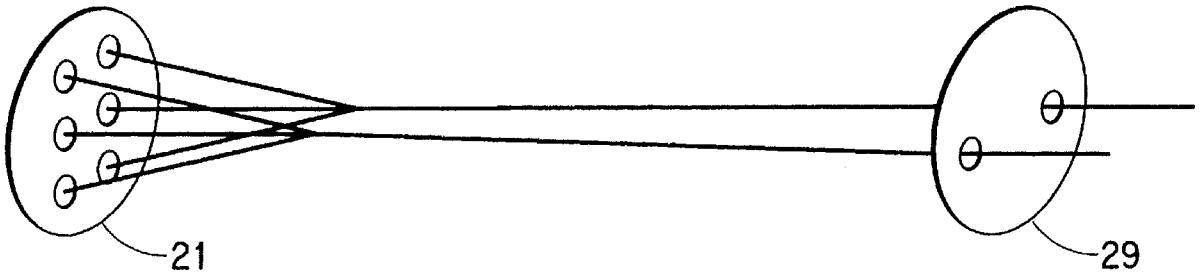
Figure 3C:
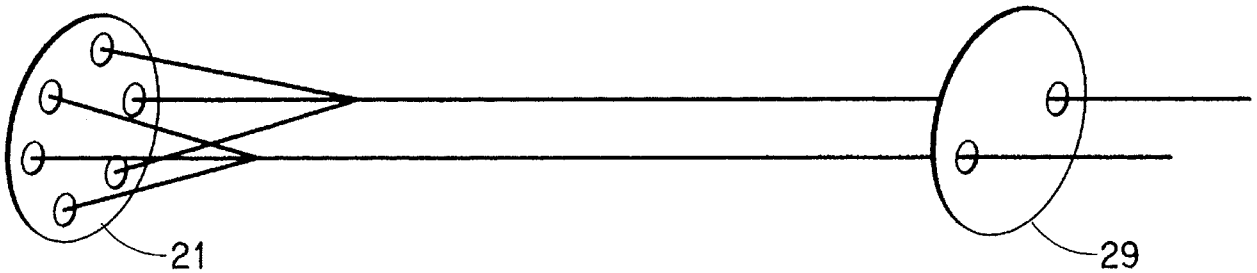

FIG. 2 shows an enlarged view of the jets 20 and 28 and the horn and anvil of bonder 22. Yarns 12 and 12*a* advance through twisting passages 21*a* and 21*b* in insert 21 of jet 20, and ply together to form plied yarn 30 just before ultrasonically energized horn 26 and anvil 27. Yarn 30 advances through twisting passage 29*a* in insert 29 of jet 28. Yarns 12*b* and 12*c* advance through twisting passages 21*c* and 21*d* in jet 20, and ply together to form yarn 30*a* which then advances through passage 29*b* in jet 28. Yarns 30 and 30*a* lie in a plane parallel to the surface 26*a* of horn 26 which extends laterally beyond the two closely spaced side-by-side yarns. Anvil 27 has a mating surface 27*a* complementary to surface 26*a* to thereby squeeze the yarns between the horn and anvil when the anvil is urged toward the horn. The rectangular footprint of the mating surfaces of the horn and anvil provides for some lateral wandering of the yarns 30 and 30*a* without changing the shape and quality of the bond. Surprisingly, by spacing the jet passages close together and the jets 20 and 28 close together with the bonder therebetween, the yarns 30 and 30*a* can be separately plied and bonded side-by-side simultaneously without entangling and bonding to one another. This results in a simplified, compact apparatus and a method that produces two or more plied yarns with minimum space and apparatus element requirements. Examples of some other passage configurations that can be used for the inserts 21 and 29 of jets 20 and 28 respectively are shown in FIGS. 3A–3C. In FIG. 3A, three ends of two ply yarn are shown; in FIG. 3B, two ends of three ply yarn are shown; in FIG. 3C, another geometry for the passages in insert 21 is shown for making two ends of three ply yarn.

After bonding, the single and plied yarns are all advanced simultaneously again and the torques applied by jets 20 and 28 are reversed to oppositely twist the singles strands 12, 12*a* and 12*b*, 12*c* and the plied yarns 30 and 30*a*, respectively. Pins 17 and 19, placed close to booster torque jet 28 form a snub 18 to resist yarn rotation and thereby allow any momentary singles twist variations to equalize before becoming highly plied. This improves ply twist uniformity, as is described in copending application Ser. No. 08/213,849, incorporated herein by reference. The yarns are advanced and periodically stopped by a pair of first driven advancing rolls 40 and a pair of second driven advancing rolls 48. The plied yarns 30 and 30*a* are each overplied by an overply torque jet 46 placed close to second advancing rolls 48 that act as a twist stop for jet 46. The overply torque jet converts the residual singles twist in the plied yarns 30 and 30*a* to ply twist. A tension on the plied yarns upstream of first rolls 64 consists of the tension caused by tensioners 16–16*c*, the drag in jet passages and guides, and the drag over snub 18; this produces a first tension on advancing plied yarns 30 and 30*a*. There is a low tension zone 41 between rolls 40 and 48 where the plied yarns 30 and 30*a* reach a first plied state in which the singles twist torque is balanced by the resistance to further ply twisting in the plied yarns. This is a second tension on the advancing yarn that is less than the first tension. The length of low tension zone 41 should be such as to contain at least one S and one Z ply twist portion (i.e. two bond lengths), several hundred turns (S plus Z) of twist, and be longer than about 100 times the distance between jet 46 and nip rolls 48. This is important so the ply twist of the yarn can fully develop and the torque effect of jet 46 on the upstream yarn in zone 41 is negligible.

In low tension zone 41, the individual plied yarn strands may pass through a preheat tube 44 to heat the yarn to a deformation temperature before overplying. This is believed to produce a bulkier yarn, aids in overplying the yarn by reducing the torque required for overplying, and reduces the twist liveliness of the yarn exhibited after it leaves nip rolls 48. The individual yarns are kept separated in the preheat tube to prevent entangling. The deformation temperature may be the glass transition temperature of the polymer although lower temperatures have also been found to be effective. The heated individual plied yarn strands each pass through a separate passage in the overply torque jet 46 positioned at the exit of preheat tube 44 and just upstream of second driven advancing rolls 48, which advance and periodically stop the individual, side-by-side, plied yarn strands in coordination with rolls 40. Overply torque jet 46 uses pressurized fluid, preferably hot pressurized fluid, to apply torque individually to yarns 30 and 30*a* in the direction of ply twist of the yarns passing through the jet to "overply" the still hot yarns 30 and 30*a* between jet 46 and rolls 48. It is important that overply jet 46 has yarn guide passages 46*a* and 46*b* upstream and downstream of jet 46 respectively. These guide the yarns 30 and 30*a* and prevent oscillation of the yarns when high pressure and flow are used to overply the yarns at high speed. The hot yarn is overplied sufficiently above the first plied state to remove all the singles twist applied to the singles strands by overplying the plied yarn 120%–200% beyond the first plied state. Second advancing rolls 48 and jet 46 are positioned along the yarn path and the yarn advancing is controlled so that when the yarns are stopped for bonding upstream at bonder 22, a previously formed bond in each individual plied strand stops near the nip of rolls 48. The torque applied by jet 46 is periodically reversed in coordination with the stopping of the previously formed bonds near rolls 48; since the ply twist is reversed adjacent each bond, the reversed torque applied by jet 46 will be acting to overply the reversed ply twist now passing through jet 46. To facilitate positioning jet 46 and rolls 48 and maintaining their alignment with the preheat tube 44, items such as jet 46, rolls 48, and tube 44 may all be mounted as shown on a carriage 51 that can be easily moved along the yarn path to change position relative to bonder 22 for different operating conditions. Alternatively, and preferably, the carriage may be held stationary, and the operating parameters for the machine cycle may be adjusted to change the bond-to-bond length of the yarns to adjust the bond position relative to the rolls 48; or both the carriage and the operating parameters may be adjusted to achieve the proper position.

After leaving the second advancing rolls 48, the yarns rapidly cool and the tension in the yarns reaches a level less than the second tension in zone 41. The individual overplied yarns 30 and 30*a* rapidly reach a second plied state that has a higher turns per inch (TPI) than the yarn in the first plied state. In the second plied state, the singles strands have a much lower residual twist, so the plied yarn is "bulky" and is "soft" to the touch compared to alternate twist plied yarn without twist conversion. The individual yarns 30 and 30*a* are brought together after rolls 48 and are allowed to spontaneously ply together to produce a second, or doubled, alternate twist plied end 90 of yarn. A booster torque jet 49 may be used to assist the plying of doubled yarn end 90 and aid in cooling the yarn. The ply twist of the doubled end reverses as the ply twist of the individual yarns reverses. There is no bond between the individual plied yarns at the reversal in the doubled yarn. A bond does not seem to be needed here to achieve the advantages of the invention. It is believed that the absence of a bond allows the individual plied yarns to shift slightly if there are momentary process tension differences between them so the tendency to form permanent loops is lessened. The plied doubled end of yarn rapidly cools and passes through aspirator jet 50 that forwards the yarn away under low tension from rolls 48 to prevent wraps and passes the yarn through a low tension accumulator tube 52. The plied yarn end is then advanced by constant speed rolls 42 to an optional heat treatment device 53 where the yarn may be heat set in the plied condition. The Superba and Suessen companies manufacture suitable ovens for heat treating the yarn in this process. One such oven may handle multiple ends of yarn at one time. For instance, the Superba model TVP-2 with optional winder accumulator MAT/2S has been found to work well for this yarn. It is important, however, that particular attention is paid to keeping the tension low in the yarn after it leaves the oven and as it leaves the accumulator wad and passes through the subsequent de-tangling bars. The tension in this section should be maintained below about 100 grams and preferably below about 50 grams for a 2000–3000 total denier doubled yarn as shown. The tension in this section should be maintained below about 50 grams and preferably below about 25 grams for a 1000–2000 total denier single plied yarn, not doubled.

Continuously running rolls 55 withdraw the plied end of yarn from the heat treatment device 53 and forward it to a winder accumulator 57 (if one is not provided with device 53) that accumulates yarn during package changes on the winder. The doubled yarn end then passes to a tensioner and guide at 54 that applies winding tension close to the package and traverses the yarn onto package 60 driven by winder motor 62. The different elements of the system are controlled by a central controller 24.

The accumulator tube 52 is long enough to contain a length of elastic yarn sufficient to stretch and develop only a low force during the brief moment rolls 48 are stopped and rolls 42 continue advancing the yarn. The tube keeps this long length of yarn from thrashing about and permits coiling to save space. The tube length also provides a yarn length long enough to allow ply twist to equilibrate to the second plied state and to allow plying of the two individual plied yarns to develop in the doubled plied end. To preserve the newly acquired bulkiness and softness in the yarn and the second ply twist level, the yarn should not be subjected to high tensions in the accumulator tube. However, it has been discovered that with the doubled plied yarn end of the invention, modest yarn handling tensions can be used in the heat treatment ovens and in the winder.

Alternatively, the two individual plied yarn strands can be kept separated after rolls 48 and the yarn handled as two separate strands that are not doubled through the oven and wound separately on a winder. In this case, the yarn should be wound at very low tension and with a short free length between the tensioner/guide at 54 and the package 60 as taught in U.S. Pat. No. 4,186,549.

Figure 4:
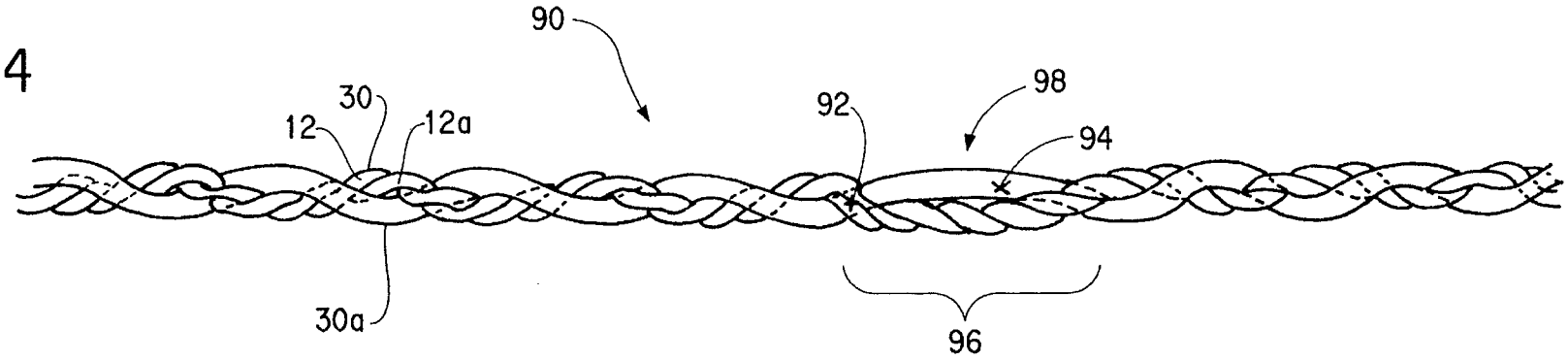
FIG. 4 is a schematic view of plied yarn of the invention.

FIG. 4 shows a diagramatic view (not to scale or proportion) of a doubled plied yarn end formed when the individual plied yarn strands are brought together and allowed to ply after rolls 48. Although only two individual plied yarns are shown, three of more plied yarns may be brought together to make up doubled yarn end 90. The doubled plied yarn end 90 is comprised of a first individual alternate twist plied yarn 30 plied with a second individual alternate twist plied yarn 30*a*. Yarn 30 is shown as two singles strands 12 and 12*a* that are plied together; yarn 30*a* has the same structure, but is shown as a single large strand for clarity. Although only two singles strands are shown making up yarns 30 and 30*a*, more than two singles strands may be plied together to make up yarns 30 and 30*a*. Singles strands 12 and 12*a* are first plied in an S-ply to the left of the Fig. and then in a Z-ply at the right of the Fig. These strands are bonded in the S-ply at the "X" at location 92, and the ply is reversed to begin the Z-ply at the right end of the bond; the very short reversal node occurs, therefore, at the right end of the bond. In yarn 30*a*, the ply bond occurs at the "X" at position 94, and the ply reversal node is at the right end of the "X".

For the doubled plied yarn 90, the Z-ply of the yarns 30 and 30*a* is to the left of the Fig and the S-ply is to the right. There is no bond in the doubled plied structure and the ply reversal node occurs over an extended length designated 96. The center of this node is at about position 98. Over the node length 96, the yarns 30 and 30*a* are somewhat parallel to one another, and due to the plying where the yarns cross each other to the left and right of the node, the yarns are held in contact with one another under low tension. This contact provides friction between strands 30 and 30*a* that resists rotation of the yarns, one relative to the other. If this rotation is prevented, the bonds and reversal nodes will not rotate and the yarns 30 and 30*a* will not lose their ply twist and reconvert it to singles twist. If tension is applied to yarn end 90, the ply twist of end 90 will decrease and the torque or twist on yarns 30 and 30*a* will increase, but this should not cause yarns 30 and 30*a* to rotate relative to one another due to their frictional contact. Therefore, yarns 30 and 30*a* can be handled as a doubled end 90 with modest handling tension without re-converting the ply twist in yarns 30 and 30*a* to singles twist.

In the process of FIG. 1, it is surprising that a previously formed bond can be accurately and repeatedly stopped between overplying torque jet 46 and second advancing rolls 48 without any bond position sensing and feedback. It is believed to be possible due to careful control of several parameters, such as:

good balanced tension in the singles yarns good singles twist uniformity;

good ply twist uniformity;

precise yarn advancing by first rolls 40;

precise yarn advancing by second rolls 48;

precise coordination of rolls 40 with rolls 48 to assure a repeatable, low tension in the yarn between the rolls during advancing;

uniform heating of yarns 30 and 30*a;* precise coordination of hot booster jet 46 with rolls 48.

Control of these parameters results in a highly repeatable bond length (i.e. distance between bonds) from one half-cycle (S-ply) to the next (Z-ply) that is essential for repeatedly and accurately stopping the bond in the nip rolls without bond position sensing and feedback.

Servo motor 64 drives first rolls 40, and servo motor 66 drives second rolls 48. These are controlled by conventional servo motor controllers (not shown) under the command of system controller 24. Motor 64 is controlled to provide desired accelerations and velocities for precise times to accurately and repeatedly advance yarns 30 and 30*a* through first rolls 40. Motor 66 likewise is controlled to accurately and repeatedly advance yarns 30 and 30*a* through second rolls 48. To maintain a low tension in the yarns between rolls, rolls 48 follow a control profile closely matched to rolls 40, but lower in amplitude, so rolls 48 advance a shorter length of yarn than rolls 40. Rolls 48 typically advance only about 90% of the length of yarn as do rolls 40. This is possible because the tension, and therefore the stretched length, of the yarn is greater feeding into rolls 40 than into rolls 48 and because the yarn shrinks and becomes shorter as it is heated between rolls 40 and 48. For instance, for a 2400 denier yarn 30, the first tension in the yarn between snub 18 and rolls 40 may be about 100 grams average and the second tension in the yarn between rolls 40 and 48 may be about 50 grams average. A tensiometer 43 may be used to monitor the tension between rolls 40 and 48. The preferred controlling of tension between rolls 40 and 48 is to have a gradually decreasing tension during a twist cycle when the yarn is advancing. This results in better ply twist uniformity in the yarn before overplying than a constant tension. This decreasing tension during yarn advancing can be accomplished by starting the yarn advancing by rolls 48 before starting the advancing by rolls 40. This produces a tension increase at the beginning of yarn advancing that is decreased during the cycle by advancing the yarn faster with rolls 40 than is required to maintain a constant tension. This will be graphically illustrated later referring to FIG. 5.

In FIG. 1, to control the timing of the yarn advancing and twisting, control 24 is connected to:

valve 100 for controlling jet 20 for twisting the single yarns in the S and Z directions;

ultrasonic transducer 102 for energizing horn 26;

valve 104 for controlling moveable ultrasonic anvil 27 for squeezing and releasing the yarn to start and stop bonding;

valve 108 for controlling jet 28 for assisting the plying of the yarns in the S and Z directions;

nip roll drive motor 64 for advancing and stopping the yarn with first driven rolls 40;

valve 110 for controlling jet 46 for overplying the plied yarns in the S and Z directions with heated fluid;

nip roll drive motor 66 for advancing and stopping the yarn with second driven rolls 48;

valve 112 for controlling jet 49 for cooling and assisting the plying of the doubled yarn end in the S and Z directions;

nip roll drive motor 114 for continuously advancing the yarn end with driven rolls 42;

nip roll drive motor 116 for continuously advancing the yarn end with driven rolls 55;

winder motor 62 for advancing and stopping the winder for winding the yarn end onto packages 60.

A hypothetical control half-cycle based on test results with various speeds and yarns, and with critical events shown at relative time units is summarized as follows:

at time 1, an arbitrary reference point in the cycle, valve 104 is energized to retract the bonder 22 to disengage the anvil from the yarns so they are free to advance;

at time 12, motor 66 is energized to drive second nip rolls 48 to begin advancing the yarns and increase the tension on the yarn since it is still held stationary by first nip rolls 40;

at time 12, valve 110 is energized to turn on overply jet 46 to overply yarns 30 and 30*a* in the S-ply direction;

at time 17, motor 64 is energized to drive first nip rolls 40 to begin advancing the yarns and begin decreasing the tension by advancing the yarns at a rate faster than nip rolls 48;

at time 17, valve 100 is energized to turn on torque jet 20 to twist the singles yarns 12, 12*a*, 12*b*, and 12*c* in the S-twist direction so they will begin plying as they advance to form plied yarns 30 and 30*a;* at time 50, valve 108 is energized to turn on booster torque jet 28 to assist plying of yarns 30 and 30*a* in the Z-ply direction;

at time 50, valve 112 is energized to turn on booster torque jet 49 to assist plying of yarn end 90 in the Z-ply direction;

at time 90, motor 64 is commanded to stop accelerating and start running at constant speed to advance the yarns 30 and 30*a* at constant speed;

at time 90, motor 66 is commanded to stop accelerating and start running at a constant speed about 10% slower than motor 64 to advance the yarns 30 and 30*a* at constant speed;

at time 440, motor 64 is commanded to start decelerating at a steady rate to decrease the advance of yarns 30 and 30*a* to improve twist uniformity near the end of the twist cycle;

at time 440, motor 66 is commanded to start decelerating at a steady rate about 10% less than motor 64 to keep tension in the yarn controlled;

at time 750, the ultrasonic transducer 102 is energized to prepare for bonding;

at time 770, motor 64 is commanded to decelerate rapidly to stop the advance of the yarns for bonding;

at time 770, motor 66 is commanded to decelerate rapidly to stop the advance of the yarns and keep the tension in the heater tube at a low level;

at time 805, nip rolls 40 and 48 have come to a stop and the yarn has stopped advancing;

at time 810, valve 110 is energized to turn off fluid flow to overply jet 46 to stop overplying the yarns 30 and 30*a;* at time 810, valve 112 is energized to turn off fluid flow to booster jet 49 to stop assisting plying of yarn end 90;

at time 830, valve 104 is energized to extend the bonder 22 to engage the yarn and squeeze it between the anvil 27 and horn 26 to bond the plied yarns 30 and 30*a* before reversing the twist;

at time 870, valve 100 is energized to turn off fluid flow to jet 20 to stop twisting yarns 12, 12*a*, 12*b*, and 12*c;* at time 870, valve 108 is energized to turn off fluid flow to booster jet 28 to stop assisting plying in yarns 30 and 30*a;* at time 880, the ultrasonic transducer is de-energized to stop bonding and permit cooling of the bond before releasing the squeezing;

at time 890, the cooling of the bond is complete, the half-cycle is ended, and the next half-cycle with opposite twisting of the yarns is ready to begin.

Figure 5:
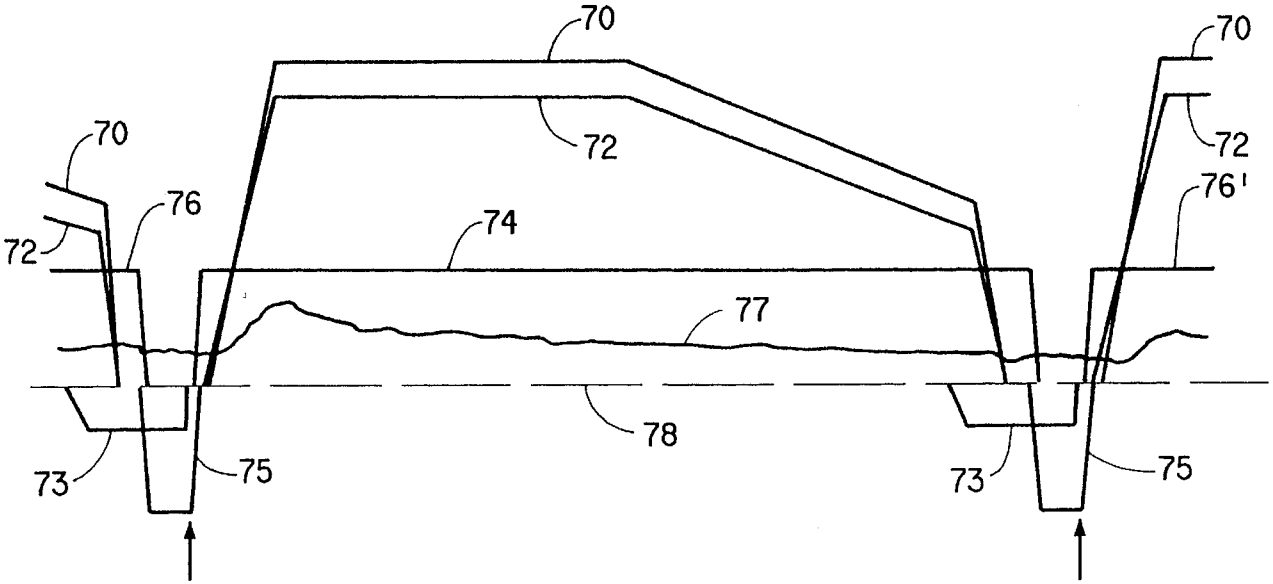
FIG. 5 is a timing diagram for the first and second advancing means and the plied yarn twisting means.

FIG. 5 graphically depicts some of the timing relationships just described between bonder 22, rolls 40, rolls 48, and jet 46 that produces the yarn of the invention having good bulk and reduced residual singles twist that resists unplying in a cut yarn tuft. The central part of the figure shows one half-cycle for overplying the yarn in the S direction. The right and left ends of the FIG. 5 show a small part of the other half-cycle for overplying in the Z direction. The S and Z half-cycles shown in FIG. 5 are substantially the same except for the direction of overplying. Trace 70 represents the speed of the yarn through rolls 40; trace 72 represents the speed of the yarn through rolls 48; trace 74 represents the condition of valve 110 that controls the twist pressure fed to jet 46 to overply the plied yarn in the S direction; and traces 76 and 76' represent the condition of valve 110 that controls the twist pressure fed to jet 46 to overply the plied yarn in the Z direction. Trace 73 represents the energizing of the ultrasonic transducer 102 connected to horn 26, and trace 75 represents the position of the bonder anvil 27 for squeezing and releasing the yarn during bonding. Trace 77 represents the output from tensiometer 43 that shows the tension in each of the yarns 30 and 30*a* between rolls 40 and 48. At the zero reference line 78, the roll speeds and yarn speeds are zero and the rolls and yarn 30 are stopped, and valve 110 has shut off the relevant pressure to jet 46 and no overplying of yarns 30 and 30*a* in the relevant direction is occurring (actually the twisting may have stopped at some level before the pressure reaches zero), and the bonder has released the yarn for advancing. It can be seen from the diagram that the overplying jet 46 shuts off shortly after the rolls 48 stop advancing the yarns so it does not unnecessarily agitate the yarns while they are stopped. To make sure the yarns are overplying in the ply direction as they start advancing again, the overply jet 46 is turned on again just as the yarns are released from the bonder and rolls 46 start advancing the yarns. It can be seen that rolls 48 start slightly before rolls 40 and then rolls 48 run slightly slower than rolls 40; the effect can be seen in the tension trace 77 that shows an initial rise in tension near the beginning of the cycle and a gradual decrease to a low level near the end.

Figures 6A, 6B, 6C, 6D, 6E:
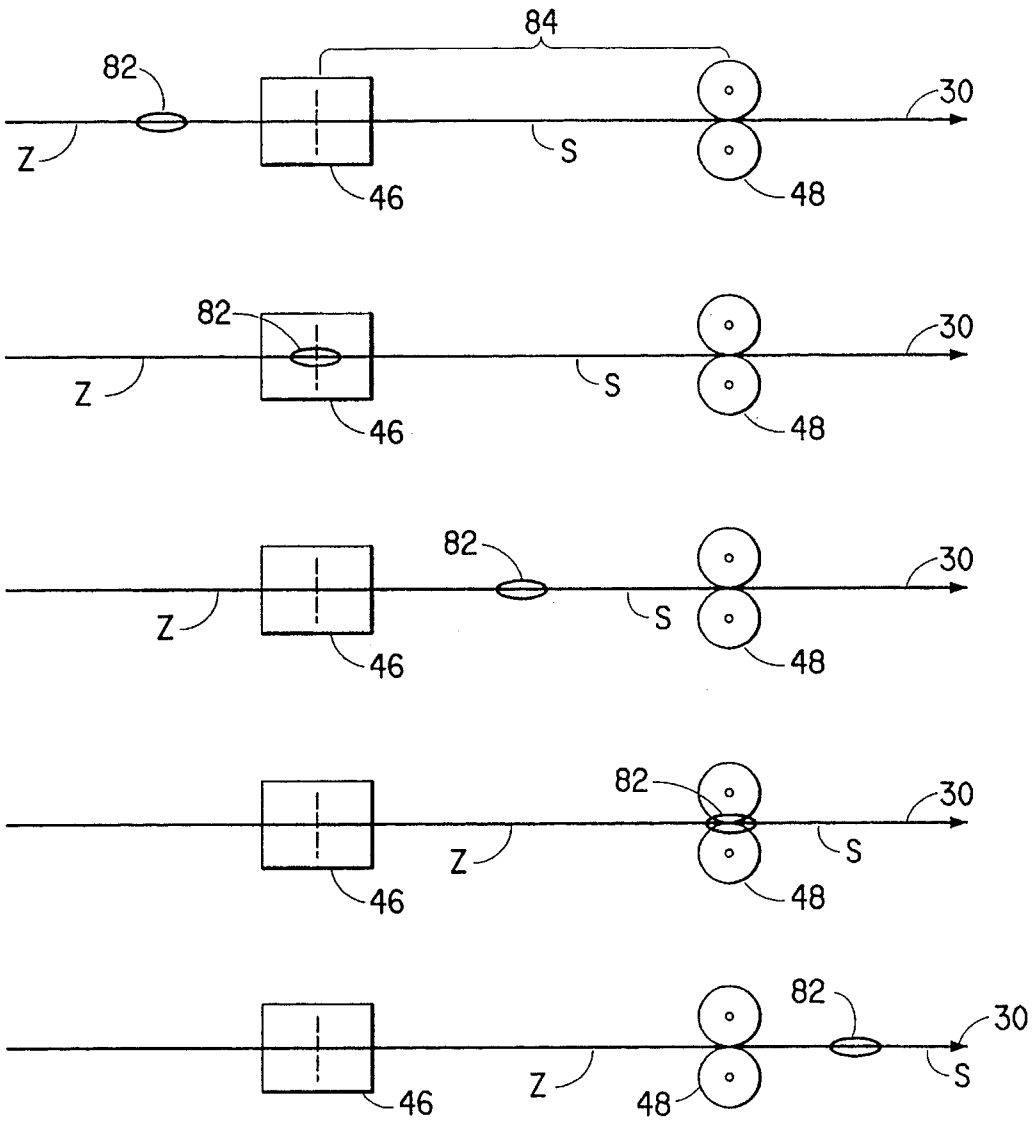
FIGS. 6A–6E show various stopped yarn conditions at the ply twist jet and the second forwarding rolls.

FIGS. 6A–6E show various positions of the bond/twist reversal that can occur when the yarn 30 is stopped. For all practical purposes, the bond and reversal node are coincident, so reference will be made to the bond only in the discussion that follows. In FIG. 6A, the bond 82 is stopped just upstream of overply jet 46, so the yarn downstream of the jet in zone 84 is being overplied in the S direction and the yarn upstream of the jet between the jet 46 and the bond 82 is being reverse plied in the Z direction (since the plying effect of the jet on the yarn is reversed on opposite sides of the jet). Due to the long length of yarn upstream of the jet, compared to downstream, the reverse plying effect is small. When the yarn is again advanced and jet 46 twisting starts in the Z direction in zone 84, the reverse plied section of yarn between jet 46 and bond 82 reaches rolls 48 without ever being overplied in the S direction and it may be reverse plied by jet 46 before the bond reaches the nip rolls 48. This condition is not preferred.

In FIG. 6B, the bond 82 is stopped in jet 46 so all of the S plied yarn is in zone 84 for S overplying. When the yarn is again advanced and jet 46 twisting starts a moment later in the Z direction in zone 84, the overplied S yarn downstream of the bond may not yet have reached rolls 48 and so may be reverse plied. It is difficult to precisely control the timing for this condition, so it is not preferred.

In FIG. 6C, the bond 82 stops between jet 46 and rolls 48, so the Z ply yarn upstream of the bond is reverse plied before the S ply pressure decays in the jet. Since this occurs over a short length of yarn between the bond and the jet, the reverse plying effect may be large, however, the stored torque in the yarn upstream of the bond 82 forward plies this short length as soon as the jet is off. When the advancing is resumed, the jet pressure begins overplying in the Z direction and the overplied S yarn downstream of the jet may get reverse plied in the Z direction before reaching rolls 48 if the timing is off. This is not the preferred operation.

In FIG. 6D, the bond 82 stops in the nip of rolls 48, so the Z ply yarn upstream of the rolls 48 is reverse plied before the S ply pressure decays in the jet 46, however, the stored torque in the yarn upstream of the bond 82 forward plies this as soon as the jet is off. Jet 46 may begin overplying in the Z direction slightly before, or just as the advancing is resumed, so the yarn will be properly overplied adjacent the upstream side of the bond. This is the preferred condition which is most easy to control and will produce good results as long as the yarn is accurately stopped in or very near the nip of rolls 48.

In FIG. 6E, the bond 82 stops beyond rolls 48, so the Z ply yarn upstream of the bond is reverse plied by the S ply pressure. The section between the bond and the rolls is never overplied in the Z direction as desired since when the jet pressure begins overplying in the reverse direction, it cannot reach any of the yarn already passed through the rolls. This is not a preferred condition.

Summarizing the observations of FIGS. 6A–6E, the preferred strategy for stopping the bond relative to jet 46 and rolls 48 is to control the system to stop the bond in the nip of rolls 48, as in FIG. 6D, and beginning overplying in the reverse direction just as or just before the yarn begins advancing. Some drift in the bond stop position upstream and downstream of the nip, as in FIGS. 6C and 6E will have a detrimental effect only on a very short length of yarn adjacent the bond. It has been observed in practice, however, that the bond can stop in any of the positions in FIGS. 6A–6E and the benefits of the invention can be enjoyed over most of the yarn length with only a small portion of yarn either upstream or downstream of the bond deviating from the desired result. Sometimes these deviations can be minimized with the timing of jets 20 and 28 that can vary the initial twist and ply put into the yarn adjacent the bond.

The stopping position of the bond can be optimized by stopping the process just after bonding and observing the bond location adjacent rolls 48, and moving carriage 51 in small increments toward and away from bonder 22 until the desired position of the bond is achieved adjacent rolls 48 and the desired condition of ply twist and singles twist is obtained adjacent the bond/reversal. Alternatively, and preferably, the carriage may be held stationary or only coarsely adjusted, and the operating parameters for the machine cycle may be adjusted to change the bond-to-bond length of the yarns to finely adjust the bond position relative to the rolls 48.

Preheat tube 44 may be heated by a combination of electric resistance heaters, such as heat tape, and hot fluid which may be steam or hot air. The heat tape may be controlled by separate controllers (not shown) for three separate portions along the length of the preheat tube to balance the heat applied to the yarn along the tube length as required. For instance, more heat may need to be added as the cool yarn first enters the tube. The hot fluid may comprise compressed air that is preheated by resistance heater 118 and is fed into the heater tube 44 at port 120 and directed in a counterflow direction to the advancing yarn. The fluid for jet 46 may also be compressed air similarly heated by resistance heater 122 or the fluid may be steam. The length of preheat tube 44 should be such that the yarns 30 and 30*a* are heated to near the deformation temperature of the yarn polymer in a time of about 0.5 seconds. The yarn is further heated to the deformation temperature by the hot fluid in jet 46 that is used to overply the yarn. The heat in the preheat tube also acts on the plied yarn to bulk it before the yarn is overplied by jet 46. It is thought to be important to the final yarn characteristics that this bulking occurs before overplying. It may also be important that the yarn is slightly unplied by jet 46 while it is in the preheat tube 44 so that the bulking is more effective on the relatively looser plied yarn. It is known that a jet in a continuous yarn line twists the yarn oppositely upstream and downstream of the jet.

Figure 7B:
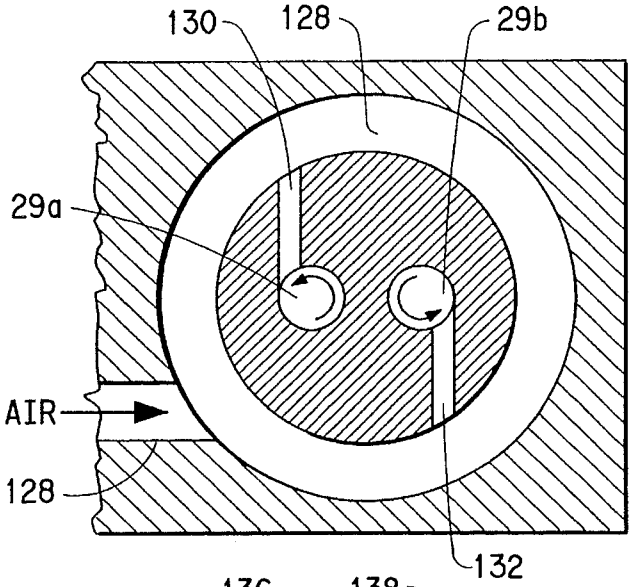
FIGS. 7A–7C show section views through a typical jet useful in practicing the invention.
Figure 7C:
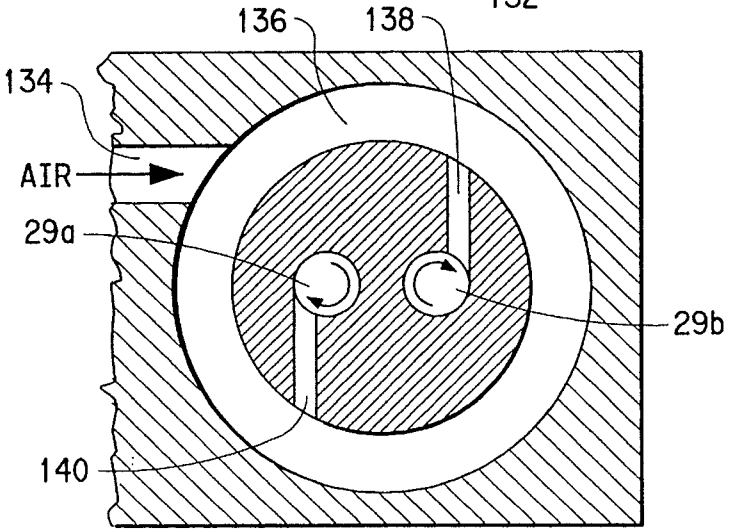
Figure 7A:
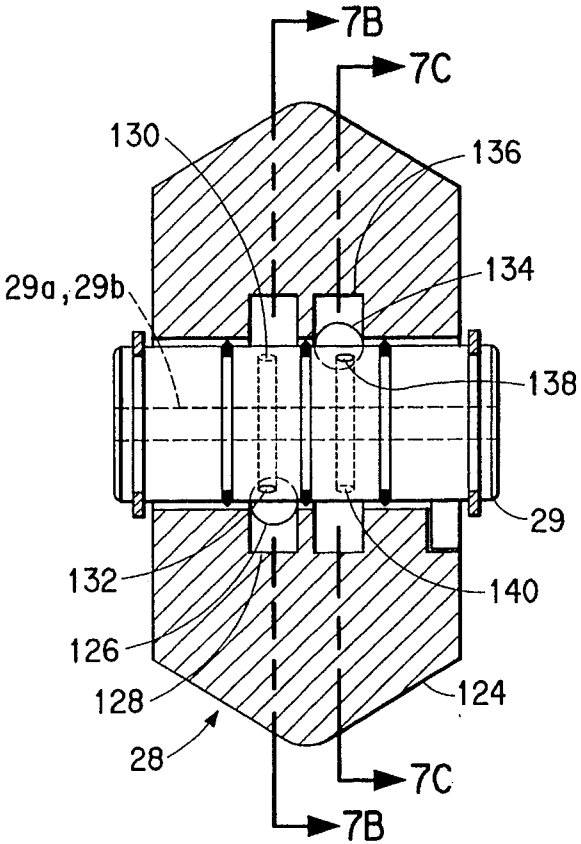

FIGS. 7A–7C show the jet referenced in the '282 patent. The figures show details characteristic of the torque jet, booster torque jets, and overply jet used in the disclosed apparatus. The figures show sections through the booster torque jet 28 in FIG. 2. The jet body 124 holds insert 29 through which extend passages 29*a* and 29*b*. Referring to FIGS. 7A and 7B, air from valve 104 (FIG. 1) in the Z twist position enters the jet body through port 126 and circulates around annular manifold 128 and through channels 130 and 132 to passages 29*a* and 29*b* respectively. This produces a clockwise flow of air in the passages that in the case of torque jet 20 will twist the singles yarns to form S-twist; and in the case of booster torque jet 28 or 49 will twist the plied yarns to assist the formation of S-ply in the yarn; and in the case of overply jet 46 will twist the plied yarns to overply them in the S-ply direction. When valve 104 is in the Z twist position, air enters through port 134 and circulates around annular manifold 136 and through channels 138 and 140 to passages 29*a* and 29*b* respectively. This produces a counterclockwise flow of air in the passages that in the case of torque jet 20 will twist the singles yarns to form Z-twist; and in the case of booster torque jet 28 or 49 will twist the plied yarns to assist the formation of Z-ply in the yarn; and in the case of overply jet 46 will twist the plied yarns to overply them in the Z-ply direction. In the case of torque jet 20, there would be two additional channels connected to each annular manifold to pass air to the two additional passages in this jet. The pressure of the air fed to the jets is set at a level suitable for the particular function of each jet. Higher pressure produces more twisting force and a higher twisting rate.

The apparatus of FIG. 1 can be operated in a variety of different ways to produce a variety of useful alternate twist plied yarn products for different needs. Table I is a matrix of some of the variables of the process for producing some exemplary products.

| OPERATING CONDITION | single or multiple plied yarn | first rolls 40 used | preheat tube 44 used | overply jet 46 used | heated overply fluid used | booster jet 49 used | yarn doubling used | heat set before winding | heat set after winding | PRODUCT comments |
|---|---|---|---|---|---|---|---|---|---|---|
| 1 | S | Y | Y | Y | Y | N | N | Y | N | single end, twist converted, heat set |
| 2 | M | N | N | N | N | N | Y | N | N | doubled, non-converted yarn |
| 3 | M | Y | N | Y | N | N | Y | N | N | twist converted, lively, heat doubled |
| 4 | M | Y | Y | Y | Y | Y | Y | N | Y | twist converted, bulky, doubled, heat set |
| 5 | M | Y | Y | Y | Y | N | N | Y | N | multiple process, twist converted, single end, heat set |

S - Single
M - Multiple
Y - Yes
N - No

Operating condition 1 produces a single end product with twist conversion and heat setting. In this case, only two singles yarns pass through jet 20 and a single plied yarn is formed and passes through booster torque jet 28 and overply jet 46; booster torque jet 49 is turned off or removed from the line as it is not needed. The unneeded passages in jets 20, 28 and 46 may be plugged or different inserts used with only the required passages. Since this yarn is somewhat sensitive to processing tension, it is best to heat set it in line instead of winding it, unwinding it, and heat treating it later offline.

Operating condition 2 produces a doubled product without any twist conversion or heat setting on-line. The first advancing rolls 40 need not be used nor the preheat tube and overply jet. Booster torque jet 49 may be used to assist doubling. Since it is a doubled yarn, more pounds per hour can be handled than with a single end of the same denier singles yarns. Also the doubled yarn can be handled with normal winding and unwinding tensions without decreasing the ply twist and increasing the singles twist. This yarn can be used as is for a loop pile carpet tuft which does not require heat setting and does not present a tuft splitting problem since the tufts are not cut.

Operating condition 3 produces a doubled product with twist conversion and no heat setting since this yarn is less sensitive to processing tension and can be more readily wound and unwound without loosing ply twist and gaining singles twist. This product was made with the preheat tube 44 turned off and unheated fluid used in the overply jet 46. This produces a very lively yarn exiting second nip rolls 48 so the plied yarns readily double together so booster jet 49 is not needed to assist plying. A high pressure is required in overply jet 46 and a low tension in zone 41 between rolls 40 and 46 to achieve a high level of twist conversion. There is a high level of TPI in the doubled yarn which is useful when the singles yarns are a small denier that may be sensitive to snagging in further processing such as off-line heat setting and tufting. The non-heat set yarn would be useful in a loop pile carpet structure which does not require heat setting since the tufts are not cut.

Operating condition 4 produces a doubled product with twist conversion that is robust for further handling so heat setting can be done off-line. The preheat tube 44 is used and hot fluid is used in overplying jet 46. The yarn coming off nip rolls 48 is not very torque lively, so booster jet 49 can be usefully employed to assist plying in the doubled yarn. This yarn is heat set later for use in a cut pile carpet and will provide good bulk and exhibit good resistance to tuft splitting.

Operating condition 5 produces two separate ends of plied yarn that each have good twist conversion. The yarn is preheated and overplied with hot fluid to produce a yarn with low torque liveliness after rolls 48. The ends are not permitted to ply together after nip roll 48 to form a doubled yarn. Instead the ends are kept separate and are heat set and wound up separately under low tension. This product is useful where the high productivity of handling two ends at once is desired, but doubled yarn in the end use is undesirable.

Although only five conditions are discussed here, it is obvious that other combinations are possible. For instance, a yarn was made with the preheat tube off and hot fluid used in the overply jet. This produced a product that was different from the product in operating condition 4. Although simplifying the equipment and process used, the different product showed less resistance to tuft splitting in a cut pile carpet. For a bulky loop pile carpet, however, this product may be preferred.

Referring to FIG. 4, it may sometimes be advantageous to not have the bonds in the individual plied yarns longitudinally aligned as they are when allowed to immediately ply together and form doubled yarn 90 upon leaving nip rolls 48. For instance, it may be desired to achieve greater resistance to tension unplying by offsetting the bonds by as much as one half the bond length, and limiting the distance over which tension is applied to a distance less than one half of a bond length. In this case, as the yarn passes between twist-stopping yarn supports, one of the plied yarns in the doubled yarn would always provide a section of yarn with no bonds present that would rotate. This axially stiffer yarn could take the tension applied to the doubled yarn and the companion yarn with a bond present would not be subjected to tension that would potentially cause bond rotation. Low TPI in the doubled yarn may result from this bond offset, but the benefits of doubled yarn would not be lost. This offset can be achieved by directing one of the yarns coming off nip roll 48 in a path of excess length before allowing it to join with the other yarn. The excess length could be as much as one half the bond length and the yarns would still be plied together. If the offset is over one half a bond length, large portions of S-ply in one yarn will be adjacent large portions of Z-ply in the other yarn so plying will be resisted by the opposing torques in the yarns.

To determine the average twist conversion and average residual singles twist in a product of the invention, the individual plied yarns, if doubled, are first separated from the doubled yarn. This can be done by manually unwrapping the alternate ply twist of the doubled yarn by holding a three bond length section of yarn and starting at the unbonded reversal in the center of the section and unwrapping the plied yarns in both directions to the ends of the section without twisting the yarn. One of the individual plied yarns is separated out and the ply twist between bonds in the individual plied yarn is then untwisted so no ply twist remains. This converts all of the ply twist achieved by the overplying process back into singles twist that was initially put into the singles strands. The number of turns of the plied yarn needed to remove all the ply twist is recorded. One of the singles is now cut at one end without allowing any rotation of the singles yarn. The one singles yarn is now untwisted until no singles twist remains and the number of turns required to remove all the singles twist is recorded. Since it is believed that the two singles nearly always have close to the same number of turns of twist between two bonds, only one of the singles may need to be examined for total turns of twist. If a machine problem produced a great descrepancy between the twist in adjacent singles yarns, the ply twist would look like a corkscrew with one singles yarn wound around the other.

By dividing the number of turns of ply twist by the number of turns of singles twist, the percent twist conversion can be obtained. By subtracting the number of turns of ply twist from the number of turns of singles twist and dividing by the number of turns of singles twist, the percent residual twist can be obtained. To achieve a reliable representation of the average, this process is repeated until at least two bond lengths of S-ply and two bond lengths of Z-ply are untwisted and at least 500 inches of yarn are untwisted. One of the singles yarns from at least one plied yarn is untwisted over the 4 bond lengths and an average singles twist is calculated.

Figure 8:
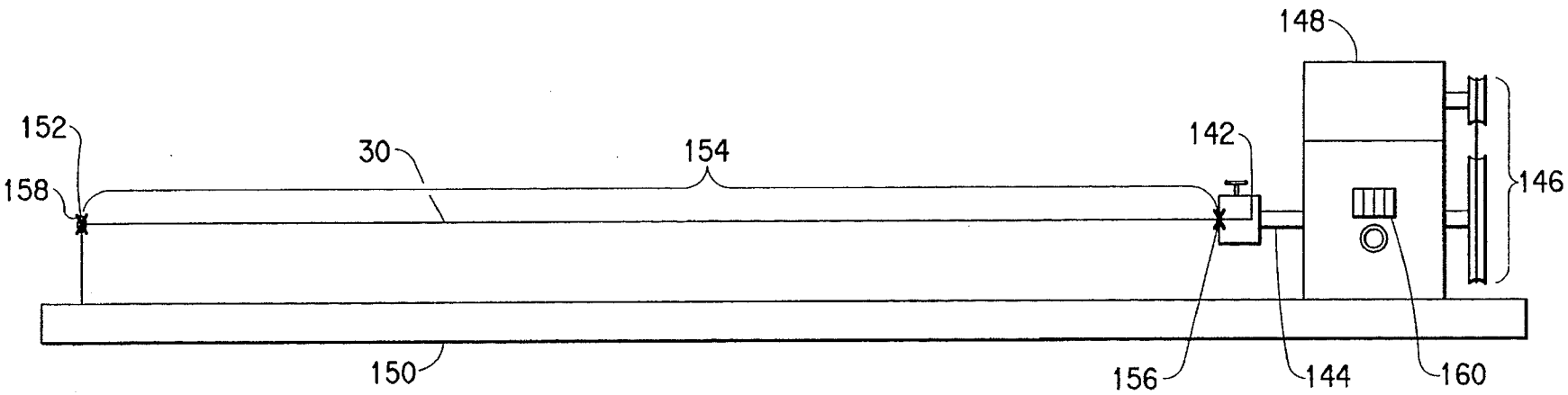
FIG. 8 shows an apparatus useful for measuring twist levels.

A device to aid in removing and counting the turns of twist is shown in FIG. 8. The ply-twist measuring device of FIG. 8 consists of a clamp 142 attached to a rotating shaft 144 driven by a pulley arrangement 146 powered by a motor 148. At an interval of one bond length away from clamp 142 along base 150 is a clip 152. A sample of alternate ply-twisted yarn 30 having a reversal length 154 between bonded reversals 156 and 158 is placed in the device. Bond 156 is placed in clamp 142 and the sample is gently extended (low or no tension) over a distance equal to the reversal length and clipped as shown in clip 152. The device has a turns counter 160 that registers the turns of shaft 144.

To collect the ply-twist data, the counter is set to zero and the motor is engaged to rotate clamp 142 to untwist the ply in the sample which may be either an S or Z ply-twist. When the strands in the yarn are unplied and parallel to one another, the motor is stopped and the turns counter is read and the data which represents the number of turns of ply-twist in the first ply interval between bonds is recorded. The counter is then reset to zero. The yarn is held tightly and released from clamp 142, the yarn is cut at the bond 156 and one of the singles strands is placed in clamp 142. The motor is engaged to rotate clamp 142 to untwist the singles twist in the sample which may be either an S or Z twist. When the filaments in the strand are untwisted and parallel to one another, the motor is stopped and the turns counter is read and the data which represents the number of turns of singles twist applied in the first ply interval between bonds is recorded. In some cases it may be necessary to untangle entanglement nodes in the single yarns to get accurate twist readings. To aid in determining when the singles strand filaments are untwisted it may be useful during the making of the sample to add a low denier tracer yarn of a contrasting color to at least one of the singles yarns back at the creel. The counter is then reset to zero and the process repeated for the next bond length.

Data for a particular set of operating conditions is gathered over at least 4 bond lengths/reversals (2S and 2Z plies). To insure a significant length of yarn is evaluated when a short bond length is being made, the sample should also include at least 500" of yarn.

EXAMPLE 1

Two singles yarns of 1005 denier each were twisted and plied into a single yarn, and twist converted at 125 YPM using a 8' long preheat tube at an average temperature of about 160 degrees C. over all three zones and using hot air in the overply jet at a temperature of about 110 degrees C. and 57 psi. The plied yarn was wound up on a winder without passing through a heat setting device. A sample was removed from a wound package and the twist conversion was measured. The average ply twist over 10 consecutive bond lengths was 338 turns over a 65" bond length (5.2 TPI) and the applied singles twist over one 65" bond length was 390 turns. This indicates a residual singles twist of 13%.

EXAMPLE 2

Four singles yarns of 550 denier each were twisted and plied into two yarns, and twist converted at 170 YPM using a 12' preheat tube at an average temperature of 160 degrees C. over all three zones and using hot air in the overply jet at a temperature of 100 degrees C. and 35 psi. The plied yarns were brought together after the second nip roll and allowed to form a doubled yarn. The yarn was wound up on a winder without passing through a heat setting device. Eighteen separate packages were wound and a sample was removed from one wound package and the twist conversion was measured. The average ply twist over 4 consecutive bond lengths was 466 turns over a 84" bond length (5.5 TPI) and the average applied singles twist over the 84" bond length was 365 turns (two singles yarns from one ply yarn were measured and averaged). This indicates a twist conversion of 128% or a residual singles twist of 28% in a direction opposite the applied twist.

EXAMPLE 3

The yarns of Examples 1 and 2 were unwound and passed through a Superba heat setting oven. In the case of Example 1, only one end was passed through the oven and it was directly wound on a package so no detangling was required. In the case of Example 2, six ends of yarn were passed through a Superba heat setting oven simultaneously. The six ends were fed to a winder accumulator and were detangled after the accumulator and each end was wound on a package.

A comparative Sample 1 was made of the same type yarn as Example 1 and it was unidirectionally ply twisted on a Volkman twister at about the same TPI and it was heat set in a Superba oven.

A comparative Sample 2 was made of the same type yarn as Example 2 and it was unidirectionally ply twisted on a Volkman twister at about the same TPI and it was heat set in a Suessen oven.

The packages from Example 1 and comparative Sample 1 were fed to a tufting machine and a carpet Sample 1 of cut pile carpet on a primary backing was made where the yarns were kept separate in the sample. Latex adhesive was used to bind the tufts to the primary. The carpet sample 1 was suitable for a bathroom rug.

The packages from Example 2 and comparative Sample 2 were fed to a tufting machine and a carpet Sample 2 of cut pile carpet on a primary backing was made where the yarns were kept separate in the sample. Latex adhesive was used to bind the tufts to the primary. The carpet sample 2 was suitable for a bathroom rug.

The carpet samples containing all the yarn samples were then separately washed in a GE household washing machine repeatedly and a subjective evaluation was made after 0, 5, and 10 washings. Water temperatures of about 100 degrees F. were used and about 0.5 g/l of Tide detergent was used on each wash cycle that included 15 minutes of wash followed by 5 minutes of rinse and a spin to remove excess rinse water. Patches were cut from the large sample after the 0, 5, and 10 washings and were dried in a household drier. Sometimes the large samples were dried after the wash cycle. The yarn samples of Example 1 and the comparative Sample 1 compared favorably; the yarn samples of Example 2 and the comparative Sample 2 compared favorably. The comparative samples had essentially no split tufts and the samples of Example 1 and Example 2 were judged to have about 10–20% split tufts after 10 washings. The examples of the invention and the comparative samples were judged to have the same overall look and feel after 10 washings.

EXAMPLE 4

Four singles yarns of 550 denier each were twisted and plied into two yarns, and twist converted at 330 YPM using a 12' preheat tube at an average temperature of 160 degrees C. over all three zones and using hot air in the overply jet at a temperature of 100 degrees C. and 71 psi. The plied yarns were brought together after the second nip roll and allowed to form a doubled yarn. The yarn was wound up on a winder without passing through a heat setting device. A sample was removed from a wound package and the twist conversion was measured. The average ply twist over 4 consecutive bond lengths was measured in three steps each since the bond length of 180" exceeded the length capacity of the measuring device. The data for the two plied yarns for each bond length is shown below:

| SAMPLE LENGTH | S/Z-PLY TURNS | Z/S-TWIST TURNS | S/Z-PLY TURNS | Z/S-TWIST TURNS | |
|---|---|---|---|---|---|
| 60" | 293 | 384 | 256 | 352 | S-PLY |
| 60" | 358 | 343 | 292 | 309 | |
| 58" | 289 | 306 | 303 | 353 | |
| 178" | 913 | 1036 | 851 | 1014 | |
| | 11.9% RESIDUAL | | 16.1% RESIDUAL | | |
| 60" | 262 | 373 | 267 | 377 | Z-PLY |
| 60" | 319 | 309 | 309 | 316 | |
| 60" | 278 | 303 | 270 | 276 | |
| 180" | 859 | 985 | 846 | 970 | |
| | 12.9% RESIDUAL | | 12.8% RESIDUAL | | |
| 60" | 262 | 356 | 263 | 346 | S-PLY |
| 60" | 332 | 309 | 322 | 287 | |
| 60" | 288 | 292 | 340 | 362 | |
| 180" | 882 | 957 | 925 | 995 | |
| | 7.8% RESIDUAL | | 7.0% RESIDUAL | | |
| 60" | 265 | 365 | 290 | 366 | Z-PLY |
| 60" | 331 | 339 | 343 | 303 | |
| 60" | 307 | 332 | 317 | 284 | |
| 180" | 903 | 1036 | 950 | 953 | |
| | 12.8% RESIDUAL | | 0.3% RESIDUAL | | |
| 718" | 3557 | 4014 | 3572 | 3932 | TOTALS |
| | 5.0 TPI AVG | | 5.0 TPI AVG | | |
| | 11.4% RESIDUAL AVG | | 9.2% RESIDUAL AVG | | |

The average residual singles twist was found to vary only slightly from one plied yarn to the other in the doubled yarn; on average only 2% difference. Therefore, sampling only one plied yarn of the double should give representative results for the other. It was felt that the overall twist conversion was good over this unusually long bond length and unusually high speed. It was believed the yarn would produce a good carpet sample, and the uniformity of the ply twisting could be improved by adjusting the timing of the twisting parameters.

EXAMPLE 5

The yarn of EX 2 had the following data.

| ONE PLIED YARN FROM A DOUBLED YARN ON ONE PACKAGE | | | | |
|---|---|---|---|---|
| BOND LENGTH | S/Z PLY TURNS | S/Z TWIST TURNS | S/Z TWIST TURNS | S/Z REV. TWIST TURNS (THEO AVG) |
| 84" | 486 S | 397 Z | 372 Z | 102 S |
| 84" | 455 Z | 349 S | 340 S | 111 Z |
| 84" | 512 S | 357 Z | 359 Z | 154 S |
| 84" | 413 Z | 375 S | 368 S | 42 Z |
| AVG TURNS | 467 | 370 | 360 | 102 |
| 128% avg converted | | | | |

Note that there is greater than 100% conversion of applied singles twist to plied twist. Theoretically, in the plied yarn at 100% conversion (0% residual singles) all of the applied singles twist is removed from the singles strands; and above 100%, the singles strands must be getting twisted in the reverse direction from the twist initially applied to generate the initial ply. The last column represents the theoretical average reverse singles twist in the strands in the 128% average overplied yarn.

When the yarn is tensioned in the winding and heat setting/rewinding process, the ply twist decreases and is re-converted into singles twist. If 100% conversion is the desired state when the yarn is finally in the carpet, then it is desireable to have the yarn at a highly overconverted state with a high reverse singles twist coming off the second advancing rolls, and after being wound into a package if the yarn is to be heat set off-line.

To illustrate the loss of ply twist that can occur with handling tension, the EX 2 lot of yarn was measured 1) as it comes off the twist converted package, 2) after going through a Superba heat treatment tunnel, and 3) after winding the heat set yarn that has gone through a Superba winder accumulator and a series of detangling bars.

| 1 COMING OFF T/C PKG PLY TURNS | 2 AFTER TUNNEL PLY TURNS | 3 AFTER WINDING PLY TURNS |
|---|---|---|
| 478 S | 427 S | 351 S -\ |
| 506 Z | 428 Z | 415 Z -/ |
| 492 avg | 428 avg | 444 S -\ |
| | | 378 Z -/ |
| | | 308 S -\ |
| | | 315 Z -/ |
| | | 291 S -\ |
| | | 283 Z -/ |
| | | 380 S -\ |
| | | 398 Z -/ |
| | | 351 S -\ |
| | | 420 Z -/ |
| | | 361 avg |

The number of turns in each column is an average of at least 4S and 4Z bond lengths of yarn. The samples in columns 1 and 2 are not from the same package of yarn and it is unknown which package in column 3 the samples in columns 1 and 2 came from. All packages were from the same lot, however. In column 3 each pair of S and Z numbers are averages from a separate package. The number of turns of ply twist drops an average of 64 turns from column 1 to 2, and drops an average of 67 turns from column 2 to 3. So the average of 102 turns of reverse singles twist may be removed during the heat treating and winding process, so there is very little residual singles twist by the time the yarn is ready for tufting into carpets. This is an advantage of preparing the yarn for heat setting with reverse singles twist present. Since the third bond length in the data for EX 2 illustrates a reverse singles twist level exceeding 43%, it is believed that levels of 60% are possible and may be beneficial.

What is claimed is:

1. An alternate twist plied yarn formed from a plurality of strands of singles yarns twisted in alternating directions in lengthwise intervals of first half-cycles of twist at a predetermined twist level followed by second half-cycles of twist at the same twist level with reversal nodes therebetween, the singles twisted yarns being ply-twisted together in alternating directions in lengthwise intervals of first half-cycles of ply-twist followed by second half-cycles of ply-twist with a reversal node therebetween, there being a bond formed adjacent each node wherein the first half-cycle of ply-twist is located within the bond and the second half-cycle of ply-twist originates at one end of the bond after the adjacent node, the twist level in the singles twisted yarns is between 25% in the same direction and 60% in the opposite direction of the twist applied to the singles yarns before plying.

2. The alternate twist plied yarn of claim 1, wherein the yarn is heat set and the twist level in the singles twisted yarn is between 25% in the same direction and 25% in the opposite direction of the twist applied to the singles yarns before plying.

3. A cut pile tufted carpet made with pile yarn comprising the yarn of claim 2.

4. A tufted carpet made with pile yarn comprising the yarn of claim 1.

5. An alternate twist plied yarn comprising:

a plurality of first alternate twist plied yarns having twist reversal nodes in each of the plurality of alternate twist plied yarns and a bond at each node, said plurality of first alternate twist plied yarns being plied together to form a second alternate twist plied yarn having unbonded ply reversal nodes, said bonded and unbonded reversal nodes being in longitudinal alignment.

6. The alternate twist plied yarn of claim 5, wherein each of said plurality of first alternate twist plied yarns comprises an alternate twist plied yarn formed from a plurality of strands of singles yarns twisted in alternating directions in lengthwise intervals of first half-cycles of twist at a predetermined twist level followed by second half-cycles of twist at the same twist level with reversal nodes therebetween, the singles twisted yarns being ply-twisted together in alternating directions in lengthwise intervals of first half-cycles of ply-twist followed by second half-cycles of ply-twist with said bonded reversal node therebetween, said bond formed adjacent each said node wherein the first half-cycle of ply-twist is located within the bond and the second half-cycle of ply-twist originates at one end of the bond after the adjacent node, the twist level in the singles twisted yarns is between 25% in the same direction and 60% in the opposite direction of the twist applied to the singles yarns before plying.

7. The alternate twist plied yarn of claim 5, wherein each of said plurality of first alternate twist plied yarns comprises an alternate twist plied yarn formed from a plurality of strands of singles yarns twisted in alternating directions in lengthwise intervals of first half-cycles of twist at a predetermined twist level followed by second half-cycles of twist at the same twist level with reversal nodes therebetween, the singles twisted yarns being ply-twisted together in alternating directions in lengthwise intervals of first half-cycles of ply-twist followed by second half-cycles of ply-twist with said bonded reversal node therebetween, said bond formed adjacent each said node wherein the first half-cycle of ply-twist is located within the bond and the second half-cycle of ply-twist originates at one end of the bond after the adjacent node, the twist level in the singles twisted yarns is between 25% in the same direction and 25% in the opposite direction of the twist applied to the singles yarns before plying.

8. A cut pile tufted carpet made with pile yarn comprising the yarn of claim 7.

9. The carpet of claim 8 wherein the denier of the singles yarns is less than 1100 denier.

* * * * *